US005621844A

United States Patent [19]

Bridges

[11] Patent Number: 5,621,844

[45] Date of Patent: Apr. 15, 1997

[54] ELECTRICAL HEATING OF MINERAL WELL DEPOSITS USING DOWNHOLE IMPEDANCE TRANSFORMATION NETWORKS

[75] Inventor: Jack E. Bridges, Park Ridge, Ill.

[73] Assignee: Uentech Corporation, Houston, Tex.

[21] Appl. No.: 396,620

[22] Filed: Mar. 1, 1995

[51] Int. Cl.[6] ..... E21B 43/00

[52] U.S. Cl. ..... 392/301; 166/60

[58] Field of Search ..... 392/301, 305, 392/306; 166/60, 302, 248

[56] References Cited

U.S. PATENT DOCUMENTS

| | | | |
|---|---|---|---|
| 3,547,193 | 12/1970 | Gill | 166/248 |
| 3,878,312 | 4/1975 | Bergh et al. | 166/248 |
| 4,508,168 | 4/1985 | Heeren | 166/248 |
| 4,524,827 | 6/1985 | Bridges et al. | 166/248 |
| 4,821,798 | 4/1989 | Bridges et al. | 166/60 |
| 5,099,918 | 3/1992 | Bridges et al. | 166/60 |
| 5,484,985 | 1/1996 | Edelstein et al. | 219/772 |

FOREIGN PATENT DOCUMENTS

| | | | |
|---|---|---|---|
| 816835 | 10/1951 | Germany | 166/60 |

*Primary Examiner*—John A. Jeffery
*Attorney, Agent, or Firm*—Dorn, McEachran, Jambor & Keating

[57] ABSTRACT

A.C. electrical heating system for heating a fluid reservoir (deposit) in the vicinity of a mineral fluid well, usually an oil well, utilizes A.C. electrical power in a range of 25 Hz to 30 KHz. The well has a borehole extending down through an overburden and into a subterranean fluid (oil) reservoir. There is a well casing including an upper electrically conductive casing around the borehole in the overburden, and at least one electrically conductive heating electrode located in the reservoir to deliver heat to the reservoir. An electrically insulating casing is interposed between the upper casing and the heating electrode. An electrically isolated conductor extends down through the casing. The heating system further includes an electrical A.C. power source having first and second outputs; the power source is usually located at the top of the well. There is a downhole voltage-reducing impedance transformation network having a primary and a secondary; in one described construction this network includes a step-down transformer. The primary of the transformation network is connected to the outputs of the power source. The secondary of the transformation network is connected to the downhole heating electrode.

22 Claims, 4 Drawing Sheets

FIG. 4

PRIOR ART EQUIVALENT CIRCUIT

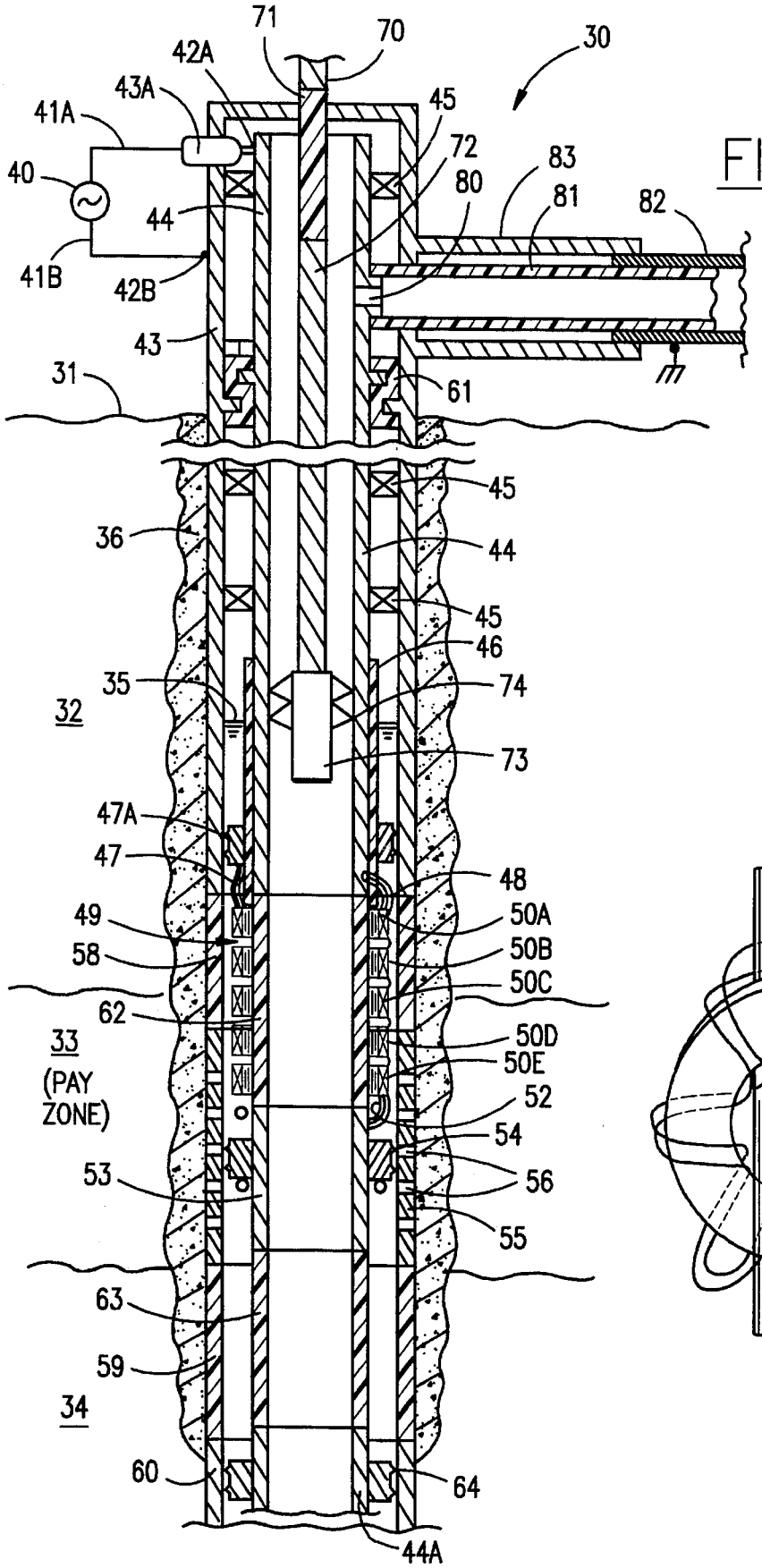
FIG. 3
FIG. 4
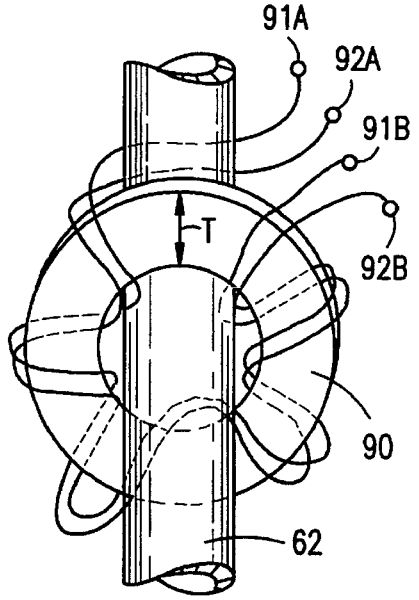

ELECTRICAL HEATING OF MINERAL WELL DEPOSITS USING DOWNHOLE IMPEDANCE TRANSFORMATION NETWORKS

BACKGROUND OF THE INVENTION

Major problems exist in producing oil from heavy oil reservoirs due to the high viscosity of the oil. Because of this high viscosity, a high pressure gradient builds up around the well bore, often utilizing almost two-thirds of the reservoir pressure in the immediate vicinity of the well bore. Furthermore, as the heavy oils progress inwardly to the well bore, gas in solution evolves more rapidly into the well bore. Since gas dissolved in oil reduces its viscosity, this further increases the viscosity of the oil in the immediate vicinity of the well bore. Such viscosity effects, especially near the well bore, impede production; the resulting wasteful use of reservoir pressure can reduce the overall primary recovery from such reservoirs.

Similarly, in light oil deposits, dissolved paraffin in the oil tends to accumulate around the well bore, particularly in screens and perforations and in the deposit within a few feet from the well bore. This precipitation effect is also caused by the evolution of gases and volatiles as the oil progresses into the vicinity of the well bore, thereby decreasing the solubility of paraffins and causing them to precipitate. Also, the evolution of gases causes an auto-refrigeration effect which reduces the temperature, thereby decreasing solubility of the paraffins. Similar to paraffin, other condensable constituents also plug up, coagulate or precipitate near the well bore. These constituents may include gas hydrates, asphaltenes and sulfur. In certain gas wells, liquid distillates can accumulate in the immediate vicinity of the well bore, which also reduces the relative permeability and causes a similar impediment to flow. In such cases, accumulations near the well bore reduce the production rate and reduce the ultimate primary recovery.

Electrical resistance heating has been employed to heat the reservoir in the immediate vicinity of the well bore. Basic systems are described in Bridges U.S. Pat. No. 4,524,827 and in Bridges et al. U.S. Pat. No. 4,821,798. Tests employing systems similar to those described in the aforementioned patents have demonstrated flow increases in the range of 200% to 400%.

A major engineering difficulty is to design a system such that electrical power can be delivered reliably, efficiently, and economically down hole to heat the reservoir. Various proposals over the years have been made to use electrical energy in a power frequency band such as DC or 60 Hz AC, or in the short wave band ranging from 100 kHz to 100 MHz, or in the microwave band using frequencies ranging from 900 MHz to 10 GHz. Various down hole electrical applicators have been suggested; these may be classified as monopoles, dipoles, or arrays of antennas. A monopole is defined as a vertical electrode whose size is somewhat smaller than the thickness (depth) of the deposit; the return electrode is usually large and is usually placed at a distance remote from the deposit. For a dipole, two vertical electrodes are used and the combined extent is smaller than the thickness of the deposit. These electrodes are excited with a voltage applied to one with respect to the other.

Where heating above the vaporization point of water is not needed, use of frequencies significantly above the power frequency band is not advisable. Most typical deposits are moist and rather highly conducting; high conductivity increases the lossiness of the deposits and restricts the depth of penetration for frequencies significantly above the power frequency band. Furthermore, use of frequencies above the power frequency band may require the use of expensive radio frequency power sources and coaxial cable or waveguide power delivery systems.

An example of a power delivery system employing DC to energize a monopole is given in Bergh U.S. Pat. No. 3,878,312. A DC source supplies power to a cable which penetrates the wellhead and which is attached to the production tubing. The cable conductor ultimately energizes an exposed electrode in the deposit. Power is injected into the deposit and presumably returns to an electrode near the surface of the deposit in the general vicinity of the oil field. The major difficulty with this approach is the electrolytic corrosion effects associated with the use of direct current.

Hugh Gill, in an article entitled, "The Electro-Thermic System for Enhancing Oil Recovery," in the Journal of Microwave Power, 1983, described a different concept of applying power to an exposed monopole-type electrode in the pay zone of a heavy oil reservoir. In his FIG. 1 Gill shows a schematic diagram wherein electrically isolated production tubing replaces the electrical cable used in the Bergh patent. The current flows from the energizing source down the production tubing to the electrode, and then returns to an electrode near the surface to complete the electrical circuit. The major difficulty with this involves two problems. First, the production casing of the well surrounds the current flowing on the tubing. In such instances, the current itself produces a circumferential magnetic field intensity which causes a large circumferential magnetic flux density in the steel well casing. Under conditions of reasonable current flow to the electrode this high flux density causes eddy currents and hysteresis losses in the casing. Such losses can absorb most of the power intended to be delivered down hole into the reservoir. The second major problem is associated with the skin effect losses in the production tubing itself. While the DC resistance of the tubing is small, the AC resistance can be quite high due to the skin effect phenomena caused by the circumferential magnetic field intensity. This generates a flux and causes eddy currents to flow. The eddy currents cause the current to flow largely on the skin of the production tubing, thereby significantly increasing its effective resistance. Such problems are minimal in the system of the Bergh patent, wherein the DC current avoids the problems associated with eddy currents and hysteresis losses.

Another method to partially mitigate the hysteresis losses in the production casing is described by William G. Gill in U.S. Pat. No. 3,547,193. In this instance the production tubing, typically made from steel, is used as one conductor to carry current to an exposed monopole electrode located in the pay zone of the deposit. Current flows outwardly from the electrode and then is collected by the much larger well casing. As implied in this patent, the design is such as to force the current to flow on the inside of the production casing, and thereby reduce by about 50% the eddy currents and hysteresis losses associated with the production casing.

Power delivery systems for implanted dipoles in the deposits have largely employed the use of coaxial cables to deliver the power. For example, in U.S. Pat. No. 4,508,168 by Vernon L. Heeren, a coaxial cable power delivery system is described wherein one element of the dipole is connected to the outer conductor of the coaxial cable and the other to the inner conductor. Heeren suggests the use of steel as a material for the coaxial transmission line which supplies RF energy to the dipole. However, it is more common practice to use copper and aluminum as the conducting material.

Unfortunately, both copper and aluminum may be susceptible to excessive corrosion in the hostile atmosphere of an oil well. This produces a dilemma, inasmuch as aluminum and copper cables are much more efficient than steel for power transmission but are more susceptible to corrosion and other types of degradation.

Haagensen, in U.S. Pat. No. 4,620,593, describes another method of employing coaxial cables or waveguides to deliver power to down hole antennas. In this instance, the coaxial cable is attached to the production tubing and results in an eccentric relationship with respect to the concentric location of the pump rod, the production tubing and the production casing. Haagensen's object is to use the coaxial cable as a wave guide to deliver power to antenna radiators embedded in the pay zone of the deposit. However, as stated previously, energy efficient materials for the wave guides or cables are usually formed from copper or aluminum, and these are susceptible to corrosion in the environment of an oil well. The conversion of AC power frequency energy into microwave energy is costly. The cables themselves, when properly designed to withstand the hostile environment of an oil well, are also quite costly. Furthermore, it appears unlikely that the microwave heating will have any significant reach into the oil deposit and the heating effects may be limited to the immediate vicinity of the well bore.

To address some of these difficulties Bridges et al., in U.S. Pat. No. 5,070,533, describes a power delivery system which utilizes an armored cable to deliver AC power from the surface to an exposed monopole electrode. In this case, an armored cable which is commonly used to supply three-phase power to down hole pump motors is used. However, the three phase conductors are conductively tied together and thereby form, in effect, a single conductor. From an above ground source, the power passes through the wellhead and down this cable to energize an electrode imbedded in the pay zone of the deposit. The current then returns to the well casing and flows on the inside surface of the casing back to the surface. The three conductors in the armored cable are copper. The skin effect energy loss associated with using the steel production tubing as the principal conductor is thereby eliminated. However, several difficulties remain. A low frequency source must be utilized to overcome the hysteresis and eddy current losses associated with the return current path through the steel production casing. Furthermore, non-magnetic armor must be used rather than galvanized steel armor. Galvanized steel armor that surrounds the downward current flow paths on the three conductors causes a circumferential magnetic flux in the armor. This circumferential flux can create significant eddy currents and hysteresis losses in the steel armor and may result in excessive heating of the cable. As a consequence, in order to avoid the excessive heating problems and losses, Monel armor is used, which is more expensive than galvanized steel armor. However, a major benefit of the approach described in Bridges et al. U.S. Pat. No. 5,070,533 is that commonly used oil field components are used throughout the system, with the exception of the apparatus in the immediate vicinity of the pay zone. Offsetting these benefits are the high cost of cable using Monel armor and the need to use a frequency converter which converts 60 Hz AC power to frequencies between 5 Hz and 15 Hz.

Another problem occurs in the case of horizontal oil wells. Typically, the boring tool is deviated such that a long horizontal borehole is formed in the oil reservoir. The well is then completed by installing a perforated casing or screen almost the entire length of the horizontal borehole. Such horizontal completions often are more than several hundred meters in length. In some reservoirs production could be greatly enhanced by the use of electrical heating. Because the spreading resistance of the electrode is inversely proportional to its length, the "electrode resistance", instead of being one to ten ohms as in the case of a vertical well, may be considerably smaller than one ohm, and could be smaller than the series resistance of the cable or tubing used to deliver power from the wellhead to the reservoir. When this occurs, most of the heating power is expended in the cable or tubing and not in the deposit. Another problem is that the flow rate from horizontal wells is quite large and substantial amounts of power, possibly in the order of several hundred kilowatts, may be expended in the deposit to obtain the full benefit of near-well bore electrical heating of the deposits for a horizontal completion.

STATEMENT OF THE INVENTION

It is a primary object of this invention, therefore, to provide an efficient power delivery system that employs a downhole impedance transformation network, usually a transformer, that may use 60 Hz power but may operate at a frequency greater than 60 Hz, and that can efficiently deliver large amounts of power into an electrode that has a small spreading resistance.

Another object is to provide a method to heat very low resistances downhole, such as may be exhibited by long vertical or horizontal electrodes or by the wall of the casing, or screens that are located in the producing zone of the deposit, to overcome any near-well bore thermally responsive impediments, such as asphaltenes or paraffins or visco-skin effects.

It is another object of this invention to provide an improved tubing/casing AC or other insulated conductor power delivery system, using a downhole transformer or other downhole impedance transformation network, which is efficient, economical, and reliable, and which is capable of delivering hundreds of kilowatts of power into the pay zone of a heavy oil or mineral deposit.

In line with these objects the following specific benefits are noted:

- Substantial reduction in the ohmic, hysteresis, and eddy-current power losses in the tubing and casing of a well.
- Elimination of the need for an expensive armored cable to deliver power downhole.
- An "electrically-cool", grounded well head, where no energized metal is exposed, with all circuits referenced to the well head.
- The use of standard, commercially available, widely used oil field equipment.
- A material cost saving by the use of existing oil-well tubing and by avoiding the use of costly cable armored with special material (e.g., monel metal).

A principal cause of the inefficiencies and difficulties associated with more conventional power delivery systems is the low "spreading resistance" presented to a heating electrode by the deposit in the immediate vicinity of the electrode. Because this resistance is so low, large amounts of current are required in order to deliver the required power. However, the large current in turn causes magnetic fields which in turn cause eddy current hysteresis losses; in many cases, these are unacceptable. To overcome the basic difficulty, a downhole voltage reducing impedance transformation network (transformer) of special design is employed. The secondary terminals of the network are attached to the electrode and to the production casing; the primary terminals are attached to the production tubing or to an electrically isolated cable, and to the production casing. Using a transformer, a higher number of turns for the transformer primary than for the secondary transforms the very low spreading resistance presented to the secondary winding to a much higher value at the primary. By increasing the value of this spreading resistance presented at the primary terminals, the amount of current required is reduced. This can reduce the eddy current and hysteresis losses which would otherwise exist in the production tubing and casing (or cables) by roughly an order of magnitude or more. Such a reduction permits a practical use of the production tubing and production casing as the principle conductors to deliver power downhole.

To introduce the transformer downhole entails the use of a toroidal transformer design with special downhole combinations of conductors, electrical insulation, tubing anchors and electrical contacts. In many cases, it may be desirable to reduce the amount of transformer materials by increasing the operating frequency to 400 Hz or even higher.

Accordingly, the invention relates to an A.C. electrical heating system for heating a fluid reservoir in the vicinity of a mineral fluid well, utilizing A.C. electrical power in a range of 25 Hz to 30 KHz. The well comprises a borehole extending down through an overburden and through a subterranean fluid (oil) reservoir; the well has a casing that includes an upper electrically conductive casing around the borehole in the overburden, at least one electrically conductive heating electrode located in the reservoir and an electrically insulating casing interposed between the upper casing and the heating electrode. An electrically isolated conductor such as a conductive production tubing extends down through the casing. The heating system comprises an electrical A.C. power source having first and second outputs, a downhole voltage-reducing impedance transformation network having a primary and a secondary, primary connection means connecting the primary of the transformation network to the first and second outputs of the power source and secondary connection means connecting the secondary of the transformation network to the heating electrode.

BRIEF DESCRIPTION OF THE DRAWINGS

FIG. 3 shows a vertical cross section, in conceptual form, of an oil well which uses an optimized production tubing and production casing power delivery system incorporating a downhole transformer;

FIG. 4 is a conceptual sketch of a simplified toroidal transformer;

DESCRIPTION OF THE PREFERRED EMBODIMENTS

Figure 1:
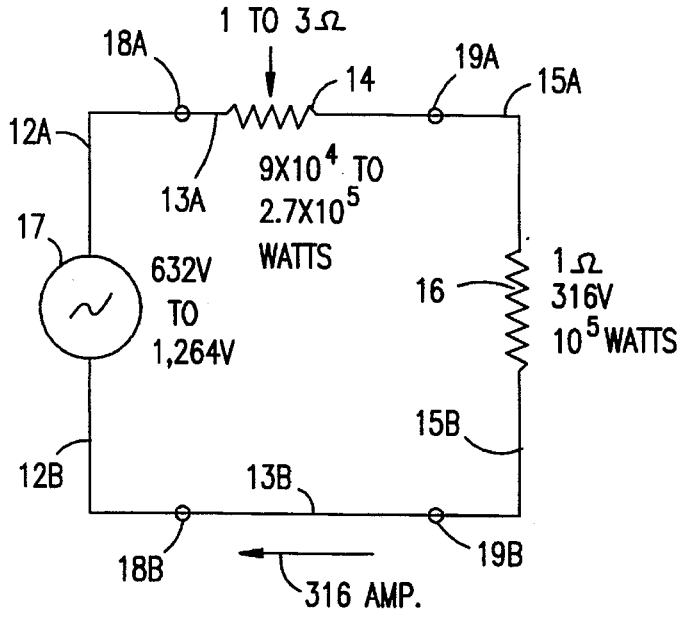
FIG. 1 is a schematic circuit diagram of an inefficient energy production tubing and production casing power delivery system as in the prior art.

FIG. 1 is a simplified schematic drawing of the equivalent circuit for a prior art power delivery system for an oil well which uses an insulated production tubing in combination with a production casing to delivery power to a downhole heating electrode 16 located in the deposit tapped by the well. The spreading resistance of the deposit presented to electrode 16 can be in the order of one ohm or less for a vertical well and may be even lower, about 0.2 ohms or less, for a horizontal well. Accordingly, the electrode resistance 16 is shown as one ohm. Typical power needed for a high producing well is in the order of 50,000 to 100,000 watts. The power supply 17 supplies power via two conductors 12A and 12B to two well head terminals 18A and 18B. These in turn energize the insulated conductive production tubing 13A and the production casing 13B, shown as conductors in FIG. 1. Conductors 13A and 13B terminate at the terminals 19A and 19B of electrode 16, which is embedded in the deposit. Conductors 15A and 15B supply power to electrode 16.

The equivalent circuit of FIG. 1 is representative of some prior art systems. The resistance presented by electrode 16 is controlled by the spreading resistance of the deposit, which in turn is proportional to the resistivity of the deposit. Typical values for this spreading resistance, as noted above, can be of the order of one ohm or less. The eddy current and hysteresis losses in the steel production tubing and steel production casing introduce an effective series resistance 14 which is schematically shown in the middle of conductor 13A.

To deliver 100,000 watts into a one ohm resistor requires a current of the order of 316 amperes. The same current flows through the electrode 16 as flows through the series resistance 14 within conductor 13A. Resistance 14 is likely to be about one to three ohms for oil wells about 600 to 1,000 meters in depth with 70 mm (2¾ in.) production tubing and 180 mm (7 in.) well casing. Thus, series resistance 14 may dissipate 100,000 to 300,000 watts, depending on its value. To deliver the required heating power under the foregoing conditions, the output voltage from voltage source 17 must range between 632 and 1,264 volts. Such an arrangement is highly inefficient and probably would result in the production tubing (13A) rising to unacceptably high temperatures, possibly causing a fire.

Figure 2:
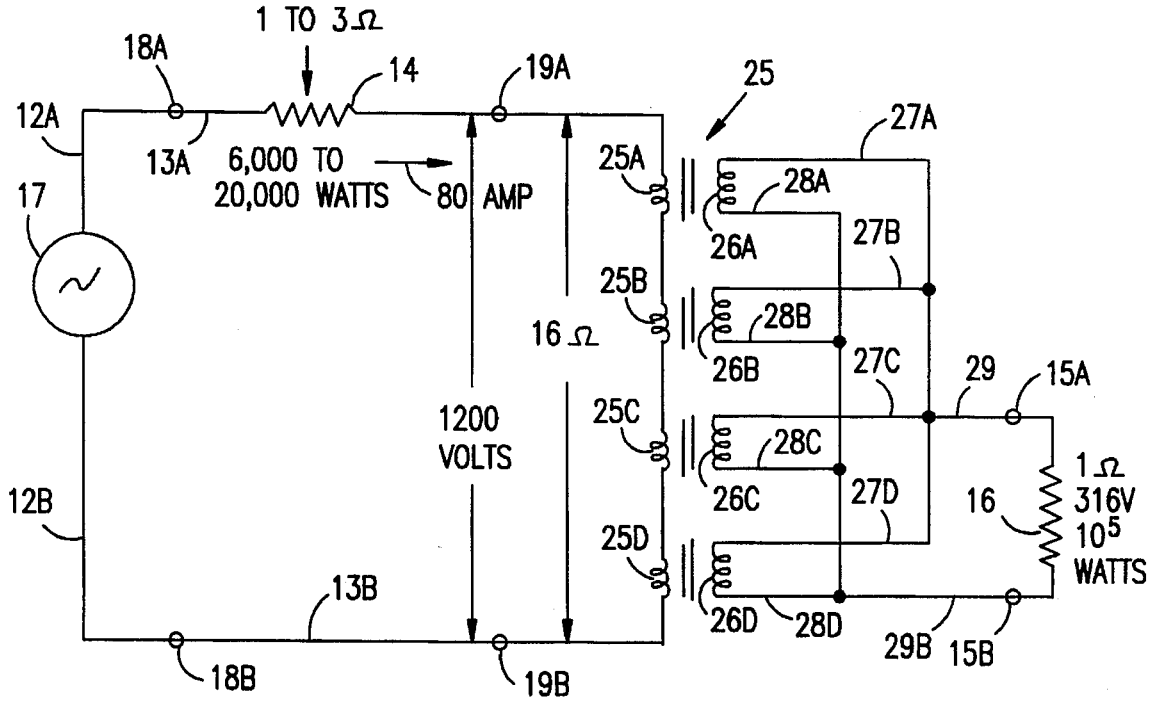
FIG. 2 is a schematic circuit diagram of an optimized production tubing and production casing power delivery system, according to the present invention, which is efficient and cost effective.

FIG. 2 is schematic circuit diagram, similar to FIG. 1 except that an impedance transformation network, shown as a transformer 25, has been connected between the terminals 19A and 19B of the tubing 13A and casing 13B of the well and the terminals 15A and 15B of heating electrode 16. In this instance, the downhole transformer assembly 25 comprises four separate toroidal transformers having primary windings 25A, 25B, 25C and 25D and secondary windings 26A, 26B, 26C and 26D, respectively. The primary windings 25A–25D are connected in series, whereas the secondary windings 26A–26D are connected in parallel via a plurality of conductors 27A, 27B, 27C and 27D and the conductors 28A, 28B, 28C and 28D. This arrangement has a primary to secondary turns ratio of 4:1. Under such circumstances, the one ohm resistance presented at terminals 15A and 15B is effectively increased, across terminals 19A and 19B, by a factor of sixteen. Two conductors 29A and 29B connect electrode 16 and its conductors 15A and 16A to the secondaries of transformer assembly 25.

In the circuit of FIG. 2, because of the higher terminal resistance presented to the tubing-casing power delivery system comprising conductors 13A and 13B, less current is needed to deliver the required power. In this case, some eighty amperes would be needed to deliver power sufficient to dissipate approximately 100 kilowatts in the one ohm resistance 16 via the transformer 25. In addition, the power dissipation in the series resistance 14 of the production tubing and casing delivery system is now reduced to a range between 6,000 and 20,000 watts. Thus, dissipation in the delivery system results in a power delivery efficiency ranging from 80% to 95%. Furthermore, the power dissipated in typical lengths of casing, which are on the order of 600 to 1,000 meters, results in power dissipation under worst case conditions, in the system illustrated in FIG. 2, between twenty and thirty watts/meter of well depth. Such a low power dissipation is quite acceptable and will not result in excessive heating of the tubing.

The values of one to three ohms for the series resistance 14 are based on actual measurements of the resistive losses introduced by eddy current and hysteresis in conventional steel tubing of 2⅞ inch (7.2 cm) diameter. For example, the series resistive losses are of the order of 0.001 ohms/meter with a 70 ampere current at a frequency of 60 Hz. This same value is increased to 0.0026 ohms/meter with 70 amperes flowing if 400 Hz current is employed. The series resistance losses in steel casing of seven inches (18 cm) diameter were measured as 0.0002 ohms/meter at 70 amperes for 60 Hz current and at 0.0005 ohms/meter at 70 amperes for 400 Hz current. The combined resistive losses for the production tubing and the production casing are of the order of 0.0012 ohms/meter at 60 Hz and 0.0031 ohms/meter at 400 Hz.

Similarly, in the case of a system in which electrical heating power is delivered downhole by an insulated single conductor cable armored with a low-cost material (e.g., steel), the eddy-current losses induced in the cable armor at 60 Hz are substantial. These losses, which have been measured, may be of the same order of magnitude as those for steel tubing. In either case, using armored single conductor cable or steel tubing to deliver electrical power downhole, eddy current and hysteresis losses can be materially reduced by reducing the amplitude of the electrical current. Current is reduced by increasing the operating voltage of the cable (or the steel tubing) and subsequently tansforming the high voltage low amplitude current from the cable or tubing to a low voltage high amplitude output capable of delivering the needed heating power into a low resistive load, the electrode 16.

The well depth for typical oil deposits is in the order of about 1,000 meters. This results in a range of one to three ohms for the series resistor 14 in the equivalent circuits presented in FIGS. 1 and 2. The one to three ohms series resistance may result in a delivery efficiency of 94% to 84%.

The series eddy current and hysteresis losses are also a function of the current, and for currents of 300 amperes would be much higher than the example values used in FIG. 1. As a consequence, the implied inefficiencies suggested in FIG. 1 would be even worse if the proper values for the series resistive losses were used for this example.

FIG. 3 is a vertical cross section, in schematic form, of an oil well 30 which uses the optimized production tubing well casing power delivery system of the invention, including a downhole transformer. A partly schematic presentation is illustrated; details such as couplers, bolts, and other features of lesser importance are not shown. The earth's surface 31 lies over an overburden 32 which in turn overlays the deposit or pay zone 33 containing oil or other mineral fluid to be produced. Below the deposit 33 is the underburden 34. The periphery of the well bore is filled with grout (cement) 36.

A voltage source 40 applies power via conductors 41A and 41B to two well head terminals 42A and 42B. Terminal 42B is connected to the wellhead casing 43. Terminal 42A, via the insulated feedthrough 43A, supplies power to the production tubing 44. Tubing 44 is electrically isolated, in the upper part of the production casing, by one or more insulating spacers 45. Below the liquid level 35 in well 30, the production tubing 44 is encased in water-impervious electrical insulation 46.

The primary windings 50A, 50B, 50C, 50D, and 50E of a downhole impedance transformation network, shown as a transformer assembly 49, are connected in series by a plurality of insulated conductors. One end of the series of primary windings is connected to the tubing 44 by an insulated conductor 48. The other end of the series-connected primary windings connected to the casing 43 via an insulated conductor cable 47 which makes contact through a contactor 47A. The secondary windings of the transformers in assembly 49 are connected in parallel, with one set of parallel secondary conductors connected to a heating electrode 55 by means of a cable 52, which makes contact with electrode 55 through a tubing segment 53 and a contactor 54. Contactors 47A and 54 may be sliding or fixed contactors, depending on the method of completion.

The portion of the well casing 43 immediately above the deposit or reservoir 33 is attached to the top of electrode 55 by an insulated fiberglass reinforced plastic pipe 58. The bottom of electrode 55 is connected to a rat hole steel casing 60 via a fiberglass reinforced plastic pipe 59. Other mechanically strong insulators can be used for plastic pipes 58 and 59. The rat hole casing 60 provides a space in well 30 where various items of debris, sand, and other materials can be collected during the final well completion steps and during operation of the well. The heating electrode 55 has perforations 56 to allow entry of reservoir fluids from deposit 33 into the interior of well 30.

The production tubing 44 is held in place at the top of well 30 by an annular serpentine capture assembly 61. Just above the top of the deposit 33, the steel production tubing 44 is interrupted by a non-conducting tube 62, which may be made of fiber reinforced plastic (FRP). Similarly, down in rat hole casing 60, the lower steel production tubing 44A is attached to the electrical contactor tube 53 by an additional section of insulated production tubing 63. Tubing 44A is attached to a tubing anchor 64. Between the tubing anchor 64 and the tubing capture assembly 61, the production tubing of well 30 can be stretched to provide tension, which suppresses unwanted physical movement during pumping operations.

A pump rod 71 is activated by a connection 70 to a horsehead pump (not shown in FIG. 3) and the mechanical forces from the pump are transmitted to a pump rod 72 by the insulated pump rod section 71. A pump member 73 is positioned within the tubing 44 by an anchor 74. Liquids and gases emerge at the surface and pass to the product collection system through an orifice 80 and through an insulated fiber reinforced plastic tube 81 to a steel product collection pipe 82. The surface of the fiber-reinforced plastic pipe 81 is protected by a steel cover 83. The steel cover 83 also serves to provide protection against electrical shock; it is electrically grounded.

All exposed metal of the wellhead of well 30, FIG. 3, is either covered with insulation, such as for cables 41A and 41B, or by metal at ground potential, such as the casing 43. The pumping apparatus is also isolated from the high potentials of the tubing by isolation section 71 in the pump rod.

FIG. 4 is a schematic illustration of one torodial transformer section for the downhole transformer assembly 49 of FIG. 3. It consists of one core and one set of windings. The core 90 is comprised of a thin ribbon of silicon steel approximately 0.6 to 1.0 mm thick wound to a radial thickness T. T has a range of approximately 0.5 to 1.5 inch (1.3 to 3.8 cm) depending on the space available in the annulus of the well between the production tubing section 62 and the well casing. Two windings are employed on core 90. Two terminals 91A and 92A represent the start of the two windings. The terminals 91B and 92B represent the termination of the two windings. These windings are bifilar; each carries the same current. The fiber-reinforced plastic tubing segment 62 passes through the center of the torodial core 90.

Figure 5:
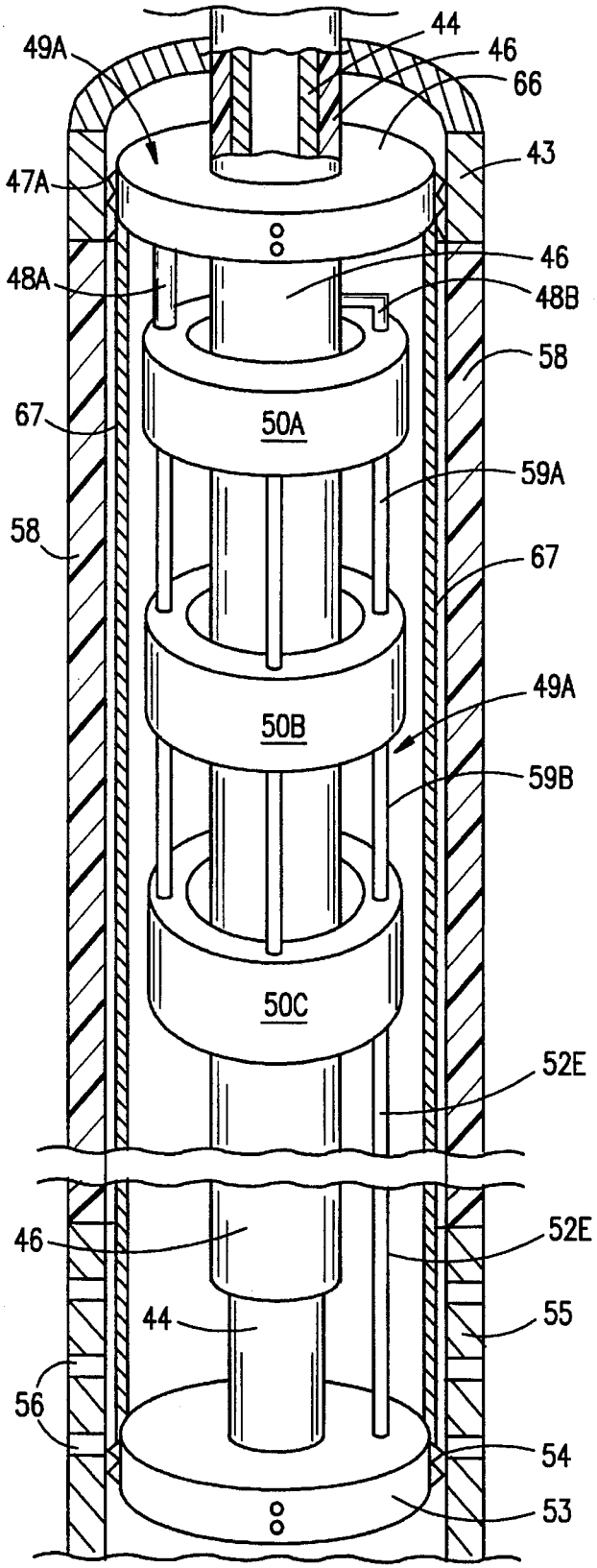
FIG. 5 is a conceptual cutaway sketch showing the general arrangement of how the downhole transformers can fit within a conventional well casing having an internal diameter of about seven inches (18 cm)

FIG. 5 is a three-dimensional illustration of the way in which the transformer assembly 49A can be packaged for use down hole. In FIG. 5 the transformer sections 50A, 50B and 50C are spaced widely apart for illustration purposes; in an actual well these transformer sections preferably would be spaced by no more than 0.5 inch (1.3 cm). Only the first three transformer sections are shown, in order to simplify the explanation.

In FIG. 5, electrical energy for heating is carried down into the well by production tubing 44 and well casing 43. As described earlier, all of the primary windings of the transformer sections 50A, 50B and 50C are connected in series and their secondaries are all connected in parallel. Interconnections are accomplished by conductor bundles 48A, 48B, 59A, 59B, and so forth. Conductor bundle 48A contacts the upper transformer casing assembly cap 66 and by internal conductors (not shown) makes electrical contact with contactor 47A to connect one side of the primary windings to the steel casing 43. The other side of the primary windings is connected to the steel production tubing 44 by like internal interconnections (not shown). The entire transformer assembly 49A is encased in a cylinder 67 which could be plastic but preferably is metal. Cylinder 67 seals the transformer assembly 49A, encluding the fluids flowing in the well from the transformers. The interstitial spaces between the transformer sections in cylinder 67 are preferably filled with a nonconducting insulator fluid such as silicon oil. The steel casing 43 is physically attached to a heating electrode 55 via a fiber-reinforced plastic pipe section 58. Connections immediately adjacent the heating electrode 55 are made by a conductor bundle 52E which connects electrically to a contactor assembly 53. Contactor 53 also serves as the bottom for the transformer encasement package and provides an electrical conduction pathway to contactors 54 which provide the contact point to the heating electrode 55.

Figure 6:
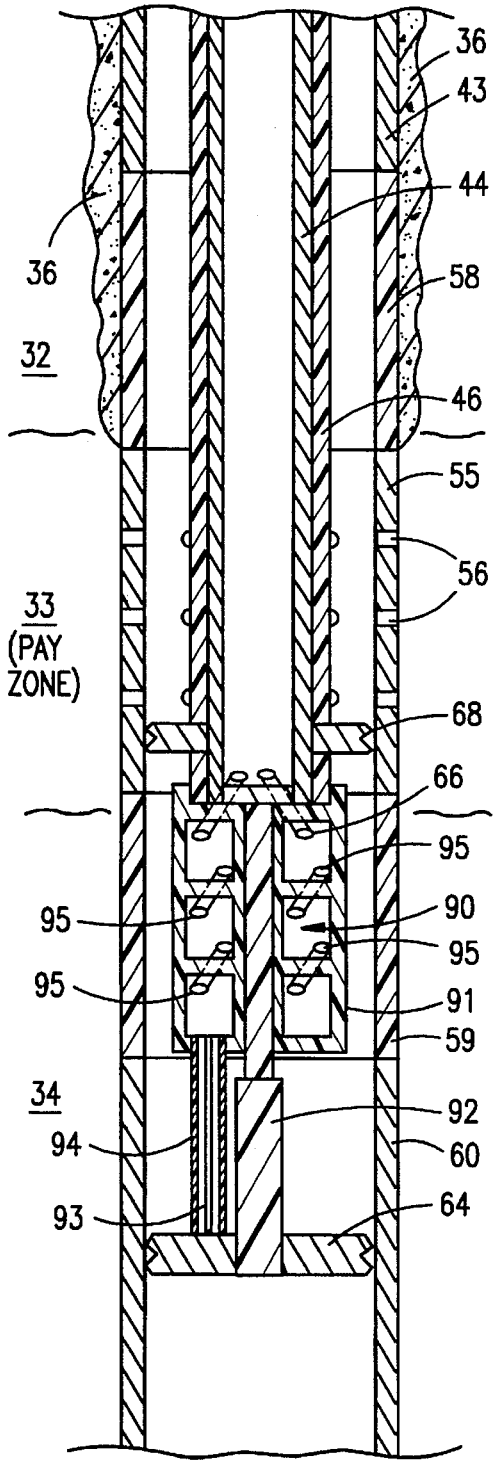
FIG. 6 is a vertical cross section showing a downhole transformer located in the rat hole portion of a production casing which lies beneath a formation being produced.

FIG. 6 illustrates installation of the transformer assembly 49 in the rat hole section of an oil well. The advantage of installing the transformer in the rat hole section is that more physical volume is available for the transformer. This is especially important if 60 Hz power sources are used, since the weight of the transformer is roughly inversely proportional to the frequency. Such a rat hole installation makes it possible to install a large downhole transformer while at the same time allowing the use of a more economical 60 Hz power supply. The advantage is even greater at 50 Hz. On the other hand, it may be more advantageous in other instances to use a smaller transformer section, in which case a higher frequency of operation may be needed. A typical practical higher frequency could range between 400 Hz and several thousand Hz. The most appropriate frequency from the standpoint of equipment depends upon the availability of power frequency conversion equipment. Such equipment is readily available at 400 Hz, which in the past has been a standard frequency for use in aircraft.

FIG. 6 shows three layers of the formation: the lower part of the overburden 32, the reservoir or pay zone 33, and the upper level of the underburden 34. The uppermost part of the well casing 43 is connected by the fiber-reinforced plastic casing 58 to the heating electrode 55, which is perforated as shown at 56. Electrode 55 is mechanically connected to a lower fiber-reinforced insulator section 59 of the casing, which in turn is attached to the steel rat hole casing section 60. The electrical power for heating is carried down the production tubing 44, which is insulated from the reservoir fluids by the external electrical insulation layer 46. Near the uppermost portion of the underburden 34, adjacent the bottom of reservoir 33, the contactor 68 makes contact between the production tubing 44 and the electrode 55. The lowermost portion of the production tubing is connected to a transformer assembly 90 via a cable bundle 66. Assembly 90 is shown as having an insulator housing 91. The connection to the metal portion of rat hole casing is made from the transformer assembly 90 by a conductor 93 attached to a tubing anchor 64. Conductor 93 is insulated from reservoir fluids by isolation tubing 94. The individual winding sections in transformer assembly 90 are interconnected by cable bundles 95. When the heating system of FIG. 6 is energized, current flows through the adjacent portion of the reservoir 33 and then returns to the transformer via currents flowing downward into the underburden 34 and then back to the metal portion 60 of the rat hole casing. The length of the rat hole casing 60 should be substantially longer, preferably three times or more, than the length of the heating electrode 55. Electrode 55 should preferably be installed in a high conductivity portion of the reservoir 33. An insulator support 92 is provided for transformer assembly 90.

Other configurations are possible to achieve the aforementioned performance and resulting benefits. Virtually any configuration for downhole transformer sections is possible, although a toroidal configuration for the cores appears to be optimum from many practical and mechanical standpoints such as supporting the core assembly and allowing the production tubing to penetrate the core assembly.

The system is optimally designed when the series resistance impedance of the electrically isolated conductors, such as the production tubing/production casing power delivery system, is no more than 30% of the load resistance as presented at the primary terminals of the power transformer. Obviously, smaller percentages of the series resistance of the tubing casing system relative to the resistance at primary terminals are desirable, because the lower this percentage the greater the power transmission efficiency.

The power transmission efficiency cannot be increased without limit by increasing the turns ratio of the power primary to secondary turns ratio of the downhole transformer. This is because the required voltage on the primary portion, including the tubing casing delivery system, will increase in proportion to the turns ratio. As a consequence, a higher turns ratio produces greater efficiency but increases voltage and insulation requirements. Such increases are limited and, from a practical viewpoint, voltages in excess of six or seven kilovolts should not be considered.

The dimensions of the toroidal portions of the transformer assembly should also be considered. Such dimensions should allow the transformer assembly to fit within the production casing with at least 0.125 inch (0.3 cm) to spare on either side. The dimensions of the toroidal transformer probably should allow for either a support rod or a section of a smaller diameter portion of the production tubing.

The simplest power supply would be a transformer which steps up a 480 volt line voltage (50 or 60 Hz) to several thousand volts as required for the improved power delivery system. Voltage applied to the power delivery system can be varied in order to control the heating rate or the power applied can be cycled in an on-off fashion.

If higher frequency operation is needed to reduce the transformer size, several options are available. The most readily available option is the use of a motor generator set wherein the generator operates at around 400 Hz. Such motor generator combinations are commercially available. Another alternative would be to use power electronic conversion. Such units can operate effectively at higher frequencies to further reduce the size and cost of the downhole power transformer. Power electronic conversion units can convert three-phase 480 volt, 60 Hz power to the appropriate, single-phase 400 Hz to 30,000 Hz output waveforms. Smaller transformers can be used to step this voltage up to the required operating level. But the frequency of the system cannot be increased without limit. One limiting factor is the series resistance of the production tubing, since that series resistance increases as the ratio of the square root of the operating frequency relative to the series resistance observed for 60 Hz. The second limiting factor is the maximum operating voltage level. For example, if 300 volts is chosen as the maximum practical safe operating level, then the maximum frequency would be on the order of 4,000 to 5,000 Hz for a well having a depth of 600 to 1,000 meters using a casing with a diameter of 7 inches (18 cm).

In most of the foregoing specification it has been assumed that commercially available A.C. power has a frequency of 60 Hz. It will be recognized that the basic considerations affecting the invention apply, with little change, where the available power frequency is 50 Hz.

Other variations and uses are possible. For example, as described in my co-pending application Ser. No. 08/397,440, filed concurrently with this application, the downhole cable should be terminated with a balanced load, such as by the primary windings of a downhole transformer. That application has been superceded by my continuation application Ser. No. 08/685,512 filed Jul. 24, 1996. The voltage source that supplies the cable may be balanced. Alternatively, one or more windings (for a multiphase transformer) of the source may be earthed (grounded) for electrical safety purposes.

Figure 7:
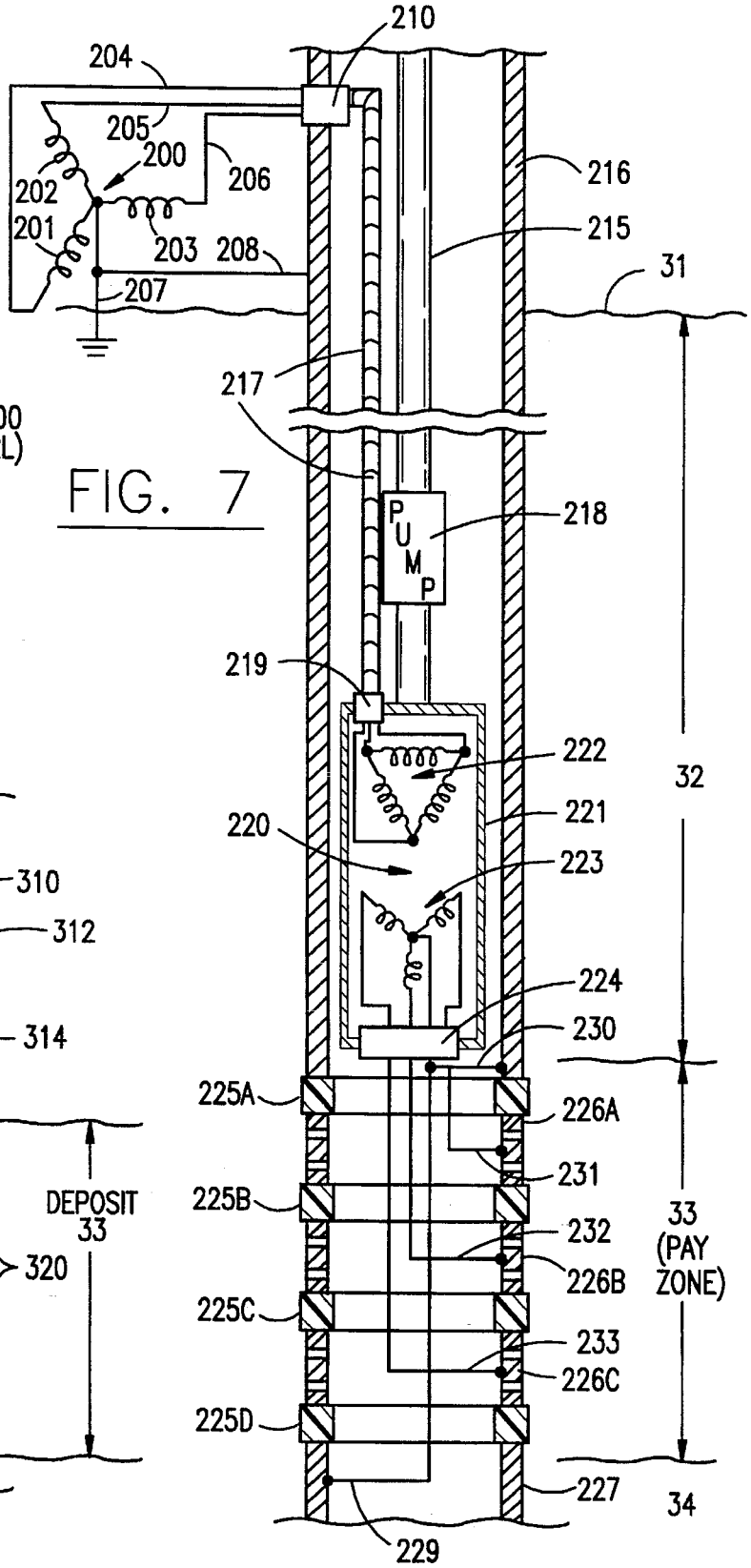
FIG. 7 is a vertical cross section, like FIG. 3, of an oil well which includes a power delivery system constructed in accordance with another embodiment of the invention.

Such an arrangement is shown in FIG. 7. FIG. 7 is a partially schematic cross-section of a portion of an oil well extending downwardly from the surface 31 of the earth, through the overburden 32 and the pay zone (deposit or reservoir) 33 and into the underburden 34. The well of FIG. 7 is completed using multiple heating electrodes 226A, 226B, 226C; the electrodes are all located in the deposit 33. In addition, the conductive casing 216 in the overburden 32 and the lower section of conductive casing 227 in the underburden 34 are also connected to the neutral of the wye-connected secondary output winding 223 of a delta-wye downhole transformer 220. The output windings are connected, via a connector 224, to the preforated electrode segments 226A, 226B and 226C of the casing by insulated cables 231, 232, and 233 respectively. The neutral of the wye output windings 223 is connected to casing sections 216 and 227 by insulated cables 230 and 229. The electrodes 226A–226C are isolated from one another and from the adjacent casing sections by insulating casing sections 225A through 225D.

Power is for the system of FIG. 7 is supplied to the well head by a wye-connected three phase transformer 200; only the secondary windings 201, 202 and 203 of power transformer 200 are shown. The neutral 207 of the transformer secondary is connected to an earthed ground and is also connected to the casing 216 by a conductor 208. Three-phase power is supplied, through the connector 210 in the wall of the casing 216 at the well head, by three insulated cables 204, 205, and 206. Power is delivered down hole via an armored cable 217 which is terminated in a connector 219. The connector then carries the three phase current through the wall of a downhole transformer container 221 and thence to the delta connected transformer primary 222. Liquids from the well are produced by a pump 218 that impels the liquids up through the production tubing 215.

The advantage of the downhole transformer configuration shown in FIG. 7 is that there is no net current flowing in the cable 217 (the upward flowing components of the current, at any time, are equal to the downward flowing components). The result is that the magnetic leakage fields are suppressed. This is a consequence of the balanced or delta termination afforded by primary 222 in device 220; extraneous current pathways either on the casing 216 or the tubing 215 are not used.

While three phase 60 Hz power may be used in the system illustrated in FIG. 7, the design of the electrodes 226A–226C and their emplacement in the deposit, pay zone 33, must be carefully considered to avoid massive three-phase power line imbalances. Such imbalances lead to under utilization of the power carrying capacity of the armored cable 217 and can require additional equipment above ground to cope with any such three-phase power line imbalances.

Figure 8:
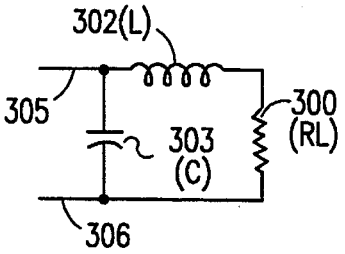
FIG. 8 is a schematic circuit diagram used to explain a different form of downhole impedance transformation network.

Other types of downhole passive transformation of power are possible. For example, at power frequencies higher than 400 Hz, resonant matching may be possible by means of passive downhole networks comprised of inductors and capacitors. Thus, rather than the classical transformer with a winding around a ferromagnetic core, a series inductor and shunt capacitor could be employed downhole as conceptually illustrated in the schematic of FIG. 8. Here, the electrode load resistance 300, having a resistance $R_L$, is in series with an inductor 302 having an inductance L. A capacitor 303 having capacitance C is connected in parallel with the series $R_L$ and L circuit, as shown. Assuming it is desired to step up the value of the load resistance 300 by a factor of $Q^2$, then the following approximate relationships can be used:

$$Q=\omega L/R_L;$$

$\omega=(LC)^{1/2}$ to present a transformed load impedance of $(Q^2)R_L$ to the cable conductors 305 and 306.

Figure 9:
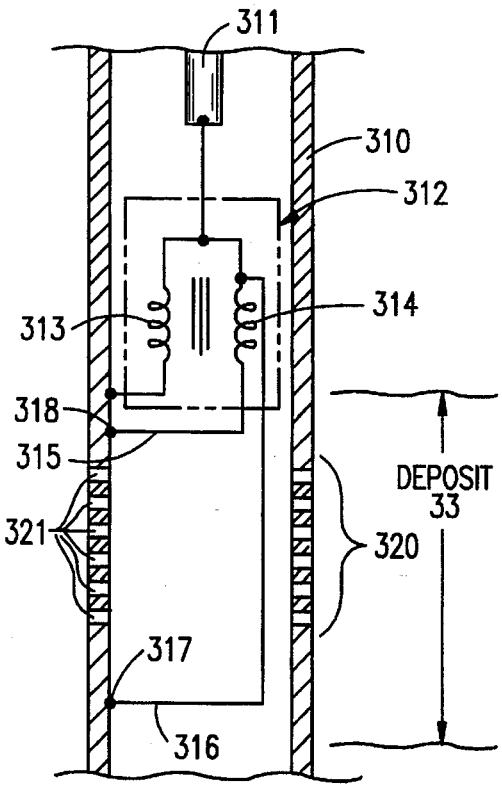
FIG. 9 is a schematic illustration employed to aid in describing heating of a downhole screen.

FIG. 9 illustrates, in schematic form, how the downhole transformer can heat a screen. The conductive well casing 310 is terminated in the deposit 33 by a screen 320 perforated by holes 321. The primary winding 313 of a downhole transformer 312 is powered by the voltage between the tubing 311 and the well casing 310. The secondary 314 of the transformer 312 is connected to the casing 310 just above the screen 320, at point 318, via an insulated conductor 315. The lower or distal part of the screen 320 is connected to the other side of the secondary 314 by an insulated conductor 316; the termination is at point 317. The voltage developed between points 317 and 315 causes a current to flow in the screen or perforated casing 320, thereby heating the screen or the perforated portion of the casing.

Screen heating arrangements like that shown in FIG. 9 may be used to supply near-well bore heating for a variety of different well completion and reservoir combinations. For example, in some horizontal completions a thermally responsive impediment, such as a skin effect, may exist in the formations around and near the well bore. This occurs because it is quite difficult to install a long horizontal screen without causing some damage to the adjacent formation. As a consequence, the production rate per meter of the screen may be quite low, of the order of a few barrels per meter per day. Substantial thermal diffusion of heat from the screen into the reservoir may occur because the heat removed from the reservoir by the slow flow of oil into the well is small. Under such conditions, and particularly for lower gravity oils, such heating may substantial increase production. Thus, the system shown in FIG. 9 is useful for heating long horizontal screens without the necessity of using an insulating or isolating section between the well casing and the screen electrode. A downhole transformer connected as shown in FIG. 9 is especially useful where the electrode spreading resistance is less than one ohm and large amounts of power, usually in excess of 100 KW, must be delivered. It is also useful to heat screens, especially for long runs of screen, exceeding one hundred feet (30 m.).

I claim:

1. An A.C. electrical heating system for heating a fluid reservoir in the vicinity of a mineral fluid well, utilizing A.C. electrical power in a range of 25 Hz to 30 KHz, the well comprising a borehole extending down through an overburden and into a subterranean fluid reservoir, the well having a casing including an upper electrically conductive casing around the borehole in the overburden, at least one electrically conductive heating electrode located in the reservoir and an electrically insulating casing interposed between the upper casing and the heating electrode, and an electrically isolated conductor extending down through the casing, the heating system comprising:

an electrical A.C. power source having first and second outputs;

a downhole voltage-reducing impedance transformation network having a primary and a secondary;

primary connection means connecting the primary of the transformation network to the first and second outputs of the power source; and secondary connection means connecting the secondary of the transformation network to the heating electrode.

2. An A.C. electrical heating system for a mineral fluid well according to claim 1 in which the isolated conductor is the production tubing for the well and the downhole impedance transformation network is a voltage-reducing transformer having a primary winding and a secondary winding magnetically linked by a common core.

3. An A.C. electrical heating system for a mineral fluid well according to claim 1 in which the impedance transformer network is a transformer that has a plurality of primary windings, a corresponding plurality of secondary windings, and a corresponding plurality of toroidal cores, with one primary winding and one secondary winding on each toroidal core.

4. An A.C. electrical heating system for a mineral fluid well according to claim 1 in which:

the A.C. power source is a three-phase source;

the downhole impedance transformation network is a three-phase voltage-reducing transformer including a primary side having three interconnected primary windings and a secondary side having three interconnected secondary windings;

and one side of the transformer is ungrounded.

5. An A.C. electrical heating system for a mineral fluid well according to claim 4 in which the primary connection means is an armored cable including three conductors, one for each phase of the power source, and the primary winding of the transformer is connected in a delta configuration with no connection to ground.

6. An A.C. electrical heating system for a mineral fluid well according to claim 1 in which the impedance transformation network is enclosed in a housing located adjacent to but outside of the fluid reservoir.

7. An A.C. electrical heating system for a mineral fluid well according to claim 6 in which the impedance transformation network is located in the overburden adjacent to the upper limit of the fluid reservoir.

8. An A.C. electrical heating system for a mineral fluid well according to claim 6 in which the impedance transformation network is located in the underburden adjacent to the lower limit of the fluid reservoir.

9. An A.C. electrical heating system for heating a fluid reservoir in the vicinity of a mineral fluid well, utilizing A.C. electrical power in a range of 25 Hz to 30 KHz, the well comprising a borehole extending down through an overburden and into a subterranean fluid reservoir, the well having a downhole electrical heating component that delivers heat into the reservoir and at least one electrically isolated conductor extending down through the borehole to the vicinity of the downhole heating component, comprising:

an electrical A.C. power source having first and second outputs;

a downhole voltage-reducing impedance transformation network having two input terminals and two output terminals;

primary connection means connecting the input terminals of the transformation network to the first and second outputs of the power source; and secondary connection means connecting the output terminals of the transformation network to the downhole heating component.

10. An A.C. electrical heating system for a mineral fluid well according to claim 9 in which the well borehole is lined with a conductive well casing and the downhole heating component is an electrode embedded in the reservoir and electrically isolated from the well casing.

11. An A.C. electrical heating system for a mineral fluid well according to claim 9 in which the downhole heating component is a multi-perforate conductive cylinder.

12. An A.C. electrical heating system for a mineral fluid well according to claim 9 in which the isolated conductor is the production tubing for the well and the downhole impedance transformation network is a voltage-reducing transformer having a primary winding and a secondary winding magnetically linked by a common core.

13. An A.C. electrical heating system for a mineral fluid well according to claim 9 in which the impedance transformer network is a transformer that has a plurality of primary windings, a corresponding plurality of secondary windings, and a corresponding plurality of toroidal cores, with one primary winding and one secondary winding on each toroidal core.

14. An A.C. electrical heating system for a mineral fluid well according to claim 9 in which:

the A.C. power source is a three-phase source;

the downhole impedance transformation network is a three-phase voltage-reducing transformer including a primary side having three interconnected primary windings and a secondary side having three interconnected secondary windings;

and one side of the transformer is ungrounded.

15. An A.C. electrical heating system for a mineral fluid well according to claim 14 in which the primary connection means is an armored cable including three conductors, one for each phase of the power source, and the primary winding of the transformer is connected in a delta configuration with no connection to ground.

16. An A.C. electrical heating system for a mineral fluid well according to claim 9 in which the impedance transformation network is enclosed in a housing located adjacent to but outside of the fluid reservoir.

17. An A.C. electrical heating system for a mineral fluid well according to claim 16 in which the impedance transformation network is located in the overburden adjacent to the upper limit of the fluid reservoir.

18. An A.C. electrical heating system for a mineral fluid well according to claim 16 in which the impedance transformation network is located in the underburden adjacent to the lower limit of the fluid reservoir.

19. An A.C. electrical heating system for a mineral fluid well according to claim 9 in which the downhole impedance transformation network is a transformer having a primary winding and a secondary winding each encompassing a toroidal core formed of a multiplicity of thin, high-resistance steel laminations.

20. An A. C. electrical heating system for a mineral fluid well according to claim 19 in which:

the transformer includes a plurality of sections each including at least one primary winding and at least one secondary winding on a toroidal core;

the primary windings are connected in series; and at least two of the secondary windings are connected in parallel.

21. An A.C. electrical heating system for a mineral fluid well according to claim 20 in which:

the load resistance of the series-connected primary windings is at least four times the resistance of the secondary windings.

22. An A.C. electrical heating system for a mineral fluid well according to claim 9 in which the resistance of the downhole electrical heating component is less than one ohm and the heating power exceeds 100 KW.

* * * * *